US006789717B2

(12) United States Patent
Ueno et al.

(10) Patent No.: US 6,789,717 B2
(45) Date of Patent: Sep. 14, 2004

(54) LOOP PIN CONNECTING DEVICE

(75) Inventors: Hideyuki Ueno, Kanagawa (JP); Junji Shiraya, Chiba (JP)

(73) Assignees: M.I.T. International Co., Ltd., Kanagawa (JP); Lasco Co., Ltd., Kashiwa (JP)

( * ) Notice: Subject to any disclaimer, the term of this patent is extended or adjusted under 35 U.S.C. 154(b) by 0 days.

(21) Appl. No.: 10/266,746

(22) Filed: Oct. 9, 2002

(65) Prior Publication Data

US 2003/0029900 A1 Feb. 13, 2003

Related U.S. Application Data

(60) Division of application No. 09/671,704, filed on Sep. 28, 2000, now Pat. No. 6,564,984, which is a continuation-in-part of application No. 09/559,425, filed on Apr. 27, 2000, now abandoned.

(51) Int. Cl.[7] ..... B65C 7/00
(52) U.S. Cl. ..... 227/67
(58) Field of Search ..... 227/67, 71, 124

(56) References Cited

U.S. PATENT DOCUMENTS

| | | | | |
|---|---|---|---|---|
| 3,735,908 A | | 5/1973 | Kinney et al. | |
| 4,536,933 A | | 8/1985 | Furutsu | |
| 5,024,365 A | | 6/1991 | Bourque | |
| 5,423,470 A | | 6/1995 | Kawada | |
| 5,472,130 A | | 12/1995 | Beringhause et al. | |
| 5,501,002 A | | 3/1996 | Fukami | |
| 5,639,006 A | * | 6/1997 | Kim | 227/67 |
| 5,683,025 A | * | 11/1997 | Grendol | 227/67 |
| 5,738,265 A | | 4/1998 | Hirai et al. | |
| 5,799,375 A | | 9/1998 | Fukami | |
| 5,813,589 A | * | 9/1998 | Kim | 227/67 |
| 5,906,039 A | | 5/1999 | Fukami et al. | |
| 6,026,544 A | | 2/2000 | Deschenes et al. | |
| 6,267,285 B1 | * | 7/2001 | Raymond et al. | 227/67 |
| 6,364,191 B1 | | 4/2002 | Deschenes et al. | |
| 6,561,406 B1 | * | 5/2003 | Furutsu et al. | 227/71 |
| 6,564,984 B1 | * | 5/2003 | Ueno et al. | 227/67 |

* cited by examiner

*Primary Examiner*—Scott A. Smith
(74) *Attorney, Agent, or Firm*—Young & Thompson

(57) ABSTRACT

A loop pin connecting device includes a grip lever rotatably pivoted to the grip section of the device proper, a driving arm rotated by the grip lever, the first pin holder section linearly traveling on the first guide rail by the driving arm, the first feeding pin mounted to the first pin holder section, the second pin holder section linearly traveling on the second guide rail by the driving arm, the second feeding pin including a flexible member whose base end is fixed to the second pin holder section, and the guide member for guiding the head end section of the second feeding pin and the guide member bends and its head end lowers to the first feeding pin position arranged with the height and horizontal position varied, entangling of the filament section is prevented and occurrence of jams in operation is prevented.

14 Claims, 14 Drawing Sheets

LOOP PIN CONNECTING DEVICE

This application is a division of application Ser. No. 09/671,704, filed on Sep. 28, 2000, now U.S. Pat. No. 6,564,984, U.S. Ser. No. 09/671,704 is a continuation-in-part of U.S. Ser. No. 09/559,425 filed Apr. 27, 2000, now abandoned the entire contents of which are hereby incorporated by reference.

BACKGROUND OF THE INVENTION

1. Field of Invention

The present invention relates to a loop pin connecting device for connecting clothes, socks, etc. or attaching tags such as brand labels, price tags, material description, instructions, etc. by inserting a latching piece to the product.

2. Description of the Related Art

In general, in order to connect clothes, daily small articles, sandals, shoes, etc. or efficiently attach brand labels, price tags, etc. to relevant products, various loop pin connecting devices have been used.

For example, the conventional loop pin connecting device forms a loop by inserting an inserting head section into a socket section held to the head end of the guiding member formed nearly semicircularly by successively feeding relevant loop pins from those temporarily fastening integrally with a joining bar a plurality of loop pins comprising an inserting head section and a socket section by grasping a hand-gun type lever. And the guiding member that holds the socket section was arranged horizontally.

However, because the above-mentioned conventional loop pin connecting device employs a gear mechanism as a mechanism for feeding two sections of inserting head and socket sections by one grip lever, the mechanism was complicated and constituted causes of failure.

In addition, because the inserting head section and the socket section must be held to the same height, the filament section was likely to get entangled, and tended to cause jams.

Furthermore, when the inserting head section is inserted to the socket section of the top pin, there were cases in which cracks occurred.

Accordingly, it is an object of the present invention to provide a loop pin connecting device that can prevent loop pin jams as well as to prevent cracks from being generated when the inserting head section is inserted into the loop pin socket section. It is another object of the present invention to provide a loop pin connecting device that has a smaller number of parts, is inexpensive and easy to manufacture, and causes less troubles.

SUMMARY OF THE INVENTION

The present invention basically adopts the configuration recited as follows in order to solve the above-mentioned problems. That is, the present invention comprises a grip lever rotatably pivoted to the grip section of a main body portion of the device, a driving arm swung by the grip lever, the first pin holder section that linearly travels on the first guide rail by the driving arm, the first feeding pin fixed to the first pin holder section, the second pin holder section that linearly travels on the second guide rail by the driving arm, the second feeding pin comprising flexible member whose base end is fixed to the second pin holder section, and a guide member for guiding a tip end section of the second feeding pin, wherein the guide member is bent and its tip end is lowered with inclination to a position at which a tip of the first feeding pin would be reached and which being three dimensionally different from the position of said second feeding pin.

The loop pin connecting device according to the present invention bends the guide member for guiding the head end section of the second feeding pin that presses out the socket section of the loop pin and at the same time lowers its head end to the position of the first feeding pin arranged with the height and horizontal position varied, and mounting the loop pins with the horizontal height position varied can prevent entangling of the filament section.

In addition, allowing the cam member to change the travel speed of the first pin holder section in the vicinity of the dead end section can prevent cracks from being generated when the inserting head section is inserted into the loop pin socket section.

DETAILED DESCRIPTION OF THE PREFERRED EMBODIMENT

Figure 1:
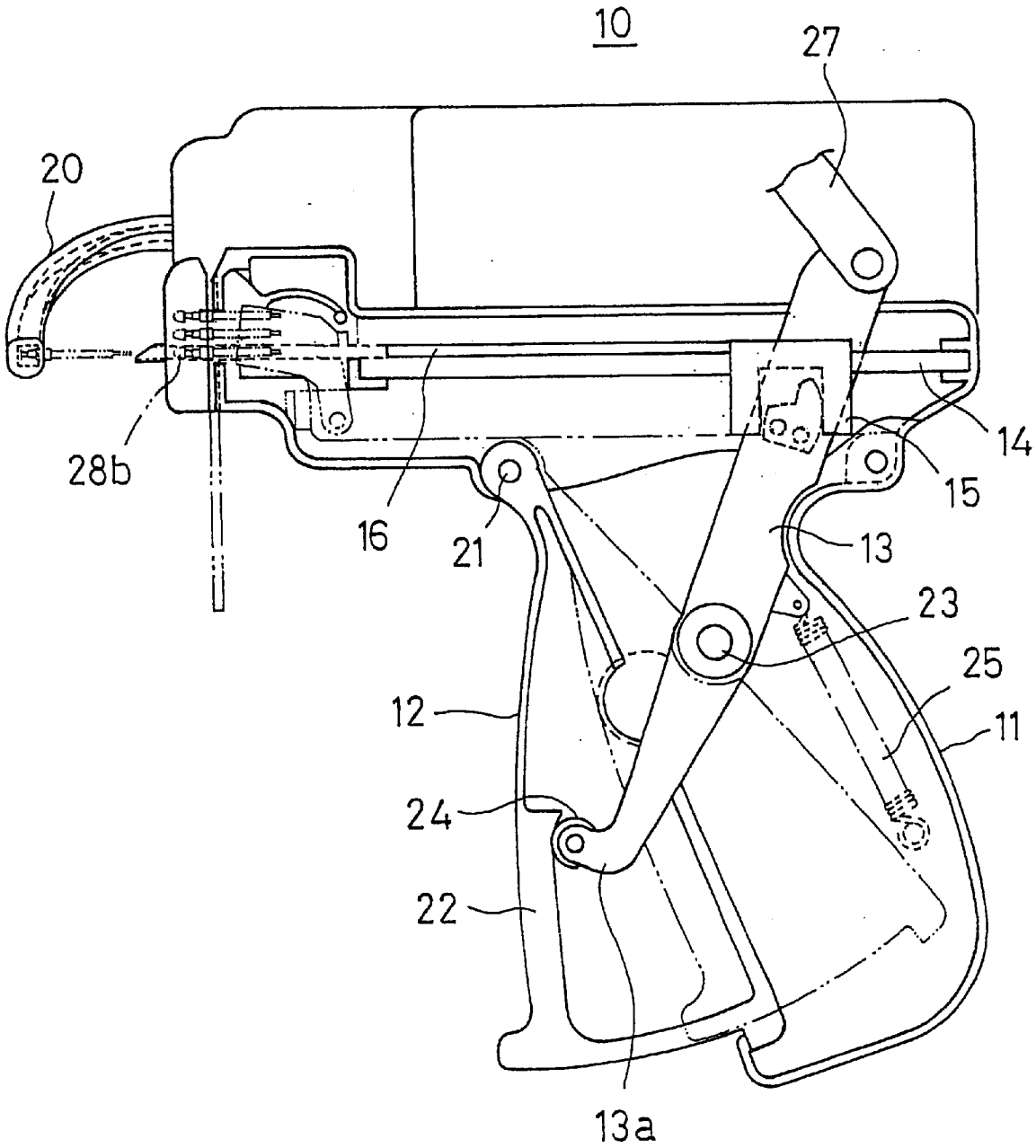
FIG. 1 is a side view showing the internal structure of the loop pin connecting device according to the present invention.

Referring now to drawings, the configuration of one specific example of a loop pin connecting device according to the present invention will be described in detail. FIG. 1 is a side view showing the internal structure of a loop pin connecting device according to the present invention. In this case, the loop pin connecting device 10 according to the present invention comprises a grip lever 12 rotatably pivoted to the grip section 11 of a main body portion of the device, a driving arm 13 swung by the grip lever 12, the first pin holder section 15 that linearly travels on the first guide rail 14 by the driving arm 13, the first feeding pin 16 fixed to the first pin holder section 15, the second pin holder section 18 that linearly travels on the second guide rail 17 by the driving arm 13, the second feeding pin 19 comprising flexible member whose base end is fixed to the second pin holder section 18, and a guide member 20 for guiding a tip end section of the second feeding pin 19, wherein the guide member 20 is bent and its tip end is lowered with inclination to a position at which a tip of the first feeding pin 16 would be reached and which being three dimensionally different from the position of said second feeding pin with height and horizontal position changed.

The second feeding pin 19 comprises a member with flexibility such as densely wound coil springs, etc.

The grip lever 12, as shown in FIG. 1, is rotatably pivoted to the pin 21 erectly built to the device proper and at the same time, on the inside surface, the first cam 22 that comes in contact with the base end section of the driving arm 13 is formed. By varying this cam profile suitably, the travel speed of the first feeding pin 16 is able to be changed. The first cam 22 is formed in such a profile to come in contact with the roller 24 constantly at right angles even when the grip lever 12 rotates around the pin 21.

The driving arm 13 is rotatably supported to the support shaft 23 erectly built to the nearly center inside surface of the grip section 11, with the base end section 13*a* bent at right angles. In addition, to the base end section 13*a*, a roller 24 is rotatably mounted. Furthermore, to part 13*b* of the driving arm 13, a spring member 25 with one end fixed to the grip section is tightly affixed. By this spring member 25, the driving arm 13 is energized to rotate clockwise. Consequently, the roller 24 at the base end section is energized in the direction to constantly come in contact with the first cam 22.

The driving arm 13 is equipped with the second cam 26 for driving the first pin holder section 15. The second cam 26 has curved sections 26*a*, 26*b* nearly symmetrically curved to both sides, as well as a pointed arm 26*c* at the top end. At the head end of the driving arm 13, a hold 13*c* is formed, to which a link member 27 for linking the second pin holder section 18 is rotatably connected. The link member 27 is connected to the head end section of the driving arm 13 by an elongated hole.

Figure 5:
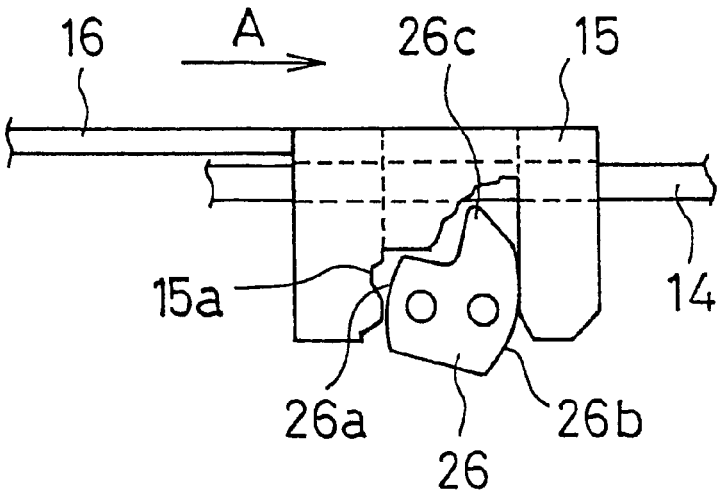
FIG. 5 is an explanatory drawing showing the relation of the first pin holder section to the driving arm used in the loop pin connecting device.
Figure 6:
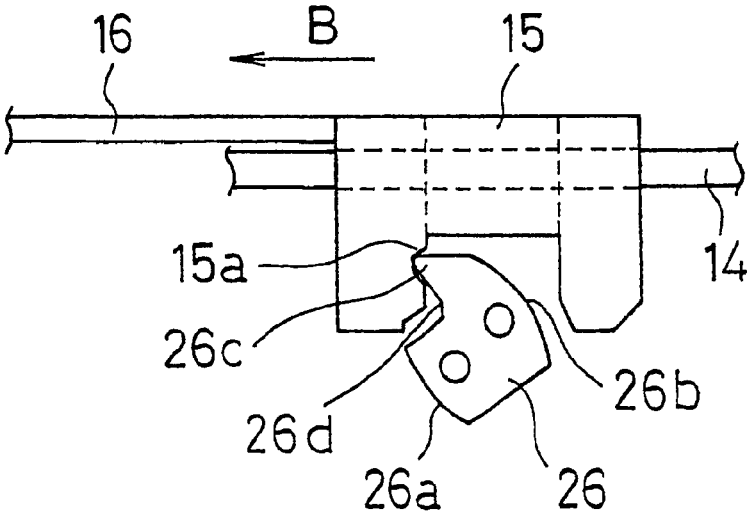
FIG. 6 is an explanatory drawing showing the relation of the first pin holder section to the driving arm used in the loop pin connecting device.
Figure 7:
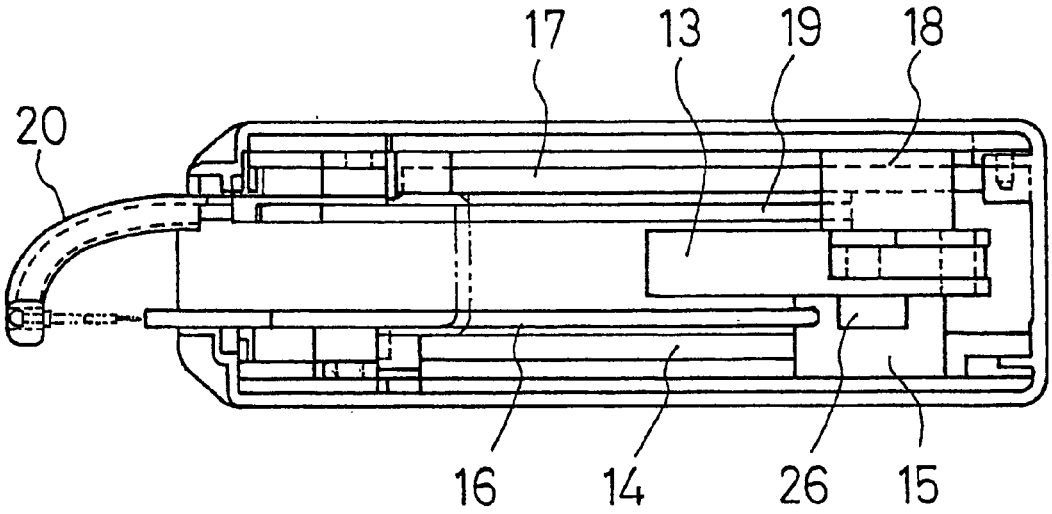
FIG. 7 is a plan view of the loop pin connecting device.
Figure 8:
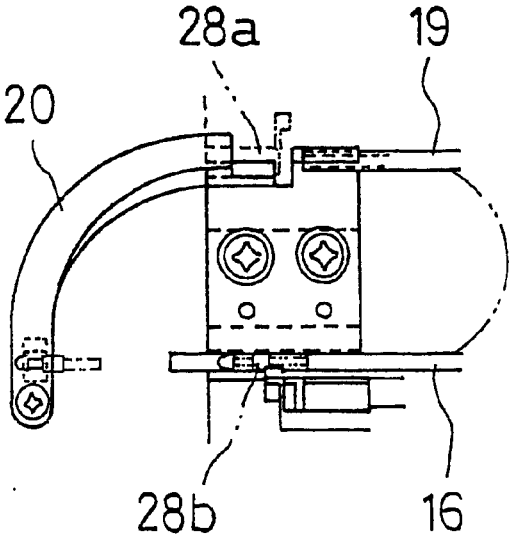
FIG. 8 is a fragmentary plan view showing the essential part of the guide member section of the loop pin connecting device according to the present invention.

FIGS. 5, 6 are explanatory drawings showing the relation of the first pin holder section 15 to the second cam 26. FIG. 5 shows the condition in which the grip lever 12 is not grasped and the driving arm 13 is energized to rotate clockwise by the spring member 25 (see FIG. 1). The first pin holder section 15 is moved in the right direction in the figure by the curved section 26*b* of the section cam 26, and the first feeding pin 16 also retracts to the depths. The second cam 26 is inserted into the recessed groove at the center of the first pin holder section 15.

Figure 2:
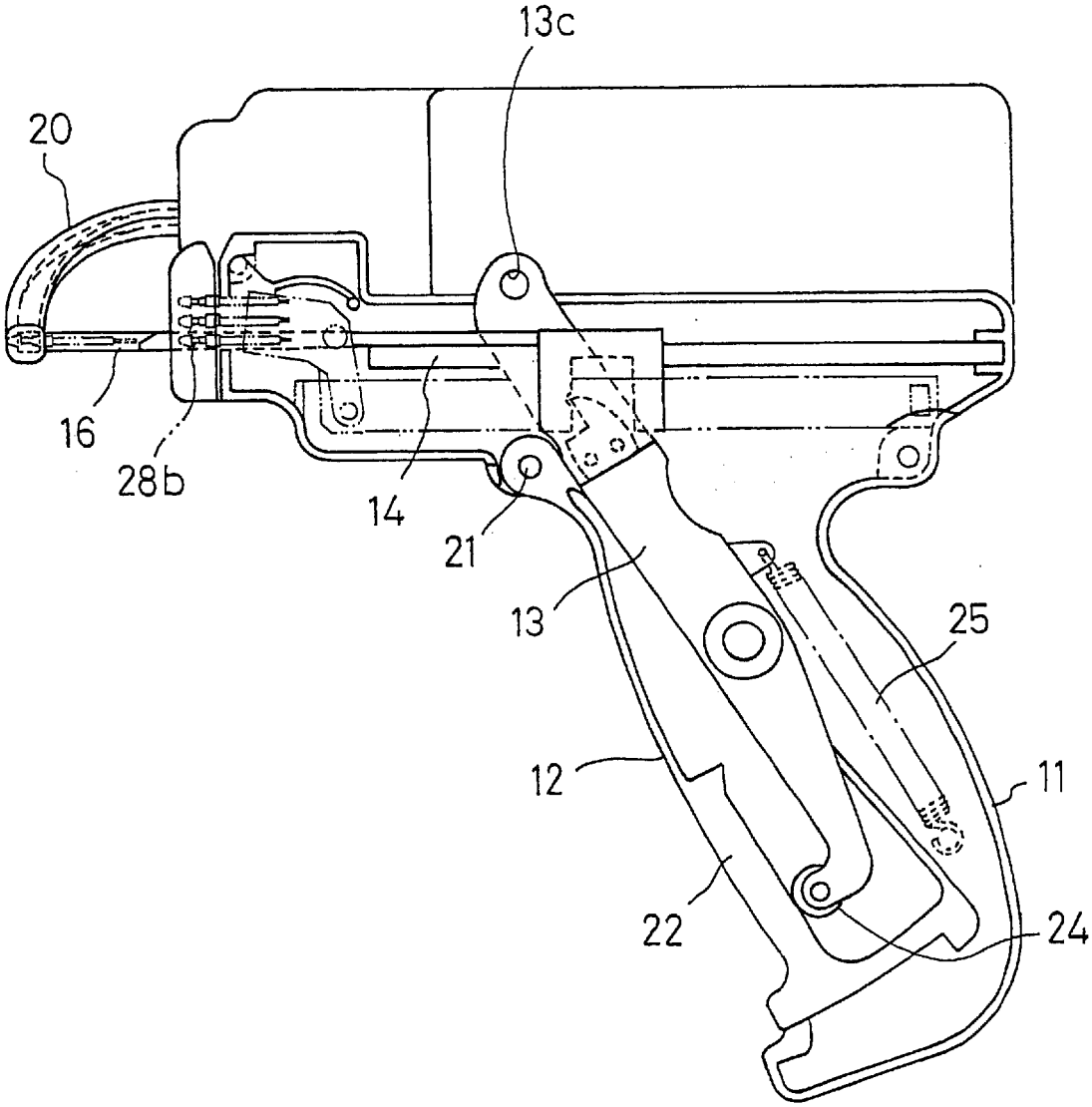
FIG. 2 is a side view showing the feeding condition of the loop pin connecting device according to the present invention.

FIG. 6 shows the condition in which the grip lever 12 is grasped and the driving arm 13 is rotated counterclockwise against the spring member 25 (see FIG. 2). The first pin holder section 15 is moved to the left direction in the drawing by the pointed head section 26*c* of the second cam 26, and the first feeding pin 16 is also protruded to the top end. The relation of the first pin holder section 15 to the second cam 26 is that the at first the recessed groove side wall of the first pin holder section comes in contact with the curved section 26*a*, but as the driving arm 13 rotates successively, the notched section 26*d* of the second cam comes in contact, and the feed speed of the first pin holder section 15 temporarily reduces in the vicinity of the dead end. In addition, at the final stage, the pointed head section 26*c* falls into the small recessed section 15*a* formed on the recessed groove side wall, and the first pin holder section 15 is able to be held in this condition.

Figure 3:
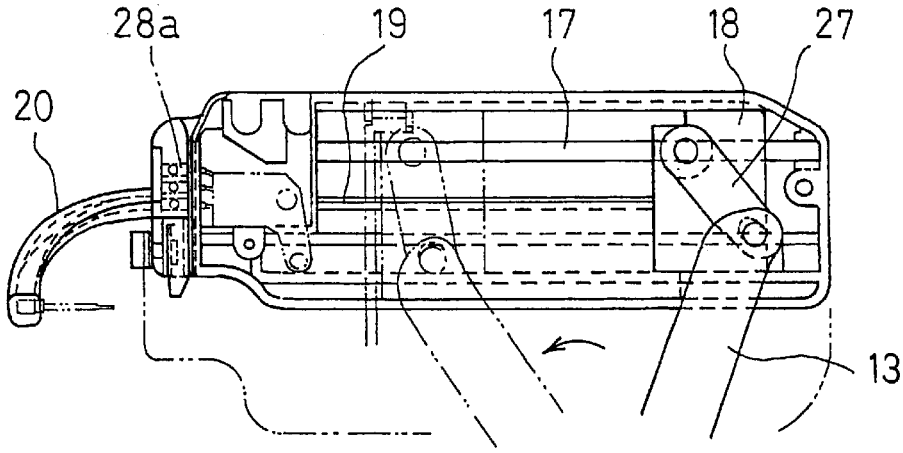
FIG. 3 is a fragmentary side view showing the essential part of the second pin holder section of the loop pin connecting device.
Figure 4:
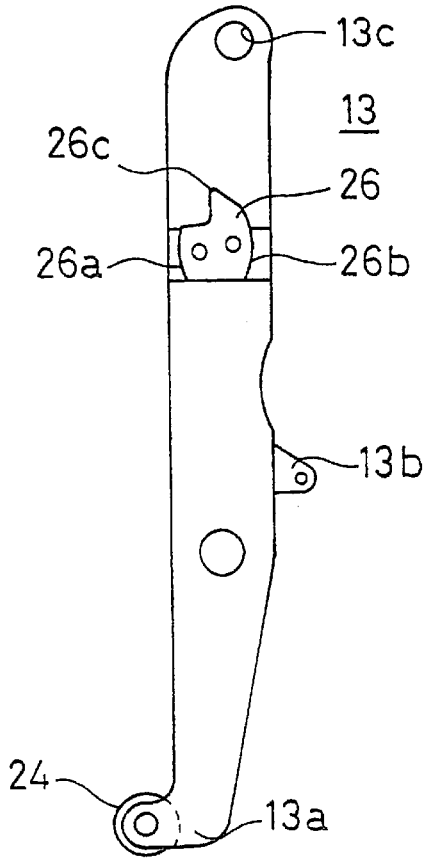
FIG. 4 is a plan view showing driving arc used for the loop pin connecting device.

The second pin holder section 18 is linked to the driving arm 13 via the link member 27, and is guided by the second guide rail 17 to carry out linear movement (see FIG. 3). When the driving arm 13 rotates counterclockwise, the link member 27 that has been pressing the second pin holder section 18 in the form of inverse V letter form rotates in a toggle form at the elongated hole section, and changes the travel speed of the second pin holder section 18 in the vicinity of the dead end section. That is, when the link member 27 rotates in the toggle form, the second pin holder section 18 scarcely moves. With this mechanism, jumping of the second feeding pin 19 is able to be prevented. Consequently, the socket section is able to be held and fixed to the head end of the guide member 20. In addition, the socket section that has arrived at the head end of the guide member 20 in advance can be kept waited.

Figure 9:
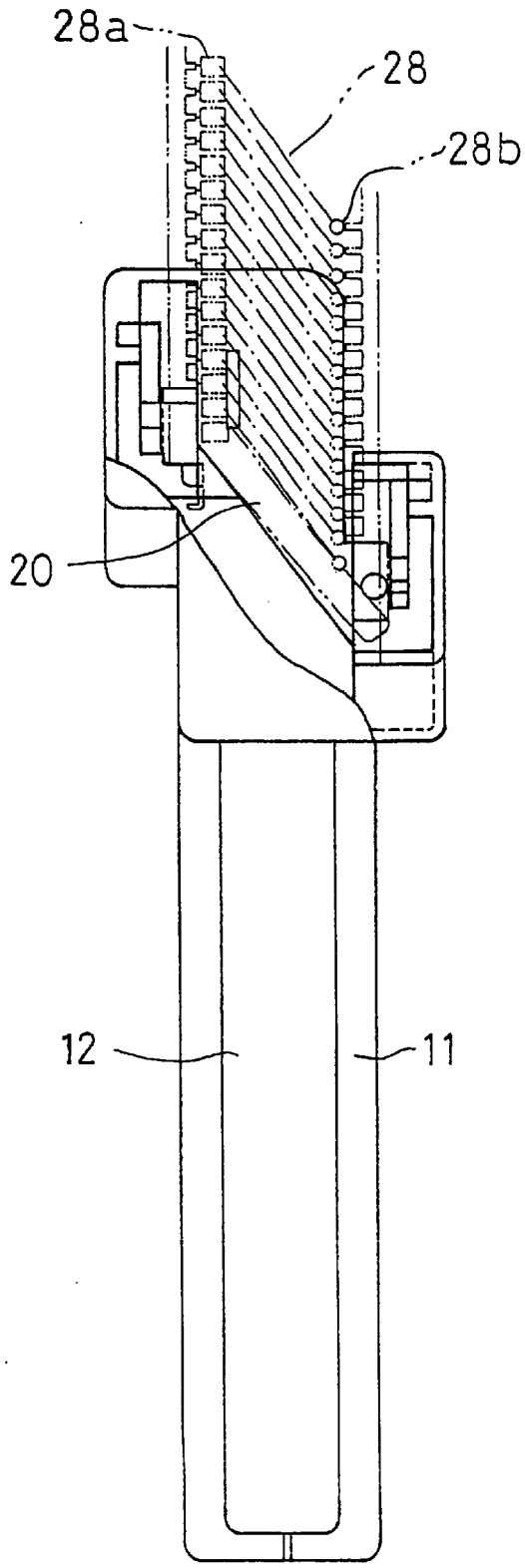
FIG. 9 is a front view partly broken away to show the loop mounted section of the loop pin connecting device.

Next description will be made on the application procedure of the loop pin connecting device configured as above. First of all, mount the loop pin 28 to the mounting section from the top surface of the device. The loop pin 28 is arranged with the socket section 28*a* set higher and the inserting head section 28*b* set lower as shown in FIG. 9. This gradient is equivalent to the gradient of the guide member 20.

Grasping the grip lever 12 rotates the driving arm 13, which rotates around the pin 21 and comes in contact with the grip lever via the roller 24, counterclockwise against the spring member 25. When the driving arm 13 rotates, the first pin holder section 15 engaged with the second cam 26 advances along the first guide rail 14. When the first pin holder section 15 advances, the first feeding pin 16 fixed to this feeds one inserting head section 28*b* forwards.

When the driving arm 13 rotates, the link member 27 connected to the head end rotates to advance the second pin holder section 18 along the second guide rail 17. Because the second pin holder section 18 is located still further from the rotation center of the driving arm 13, it advances at a speed faster than that of the first pin holder section 15. Because the distance in which the socket section 28*a* arrives at the head end position while passing through the guide member 20 is longer than that in which the inserting head section 28*b* advances straight, the moving stroke should be set longer accordingly. The moving timing of both should be set in such a manner that the socket section 28*a* arrives first and thereafter the inserting head section 28*b* arrives next to engage.

Because the first feeding pin 16 has the advancing speed temporarily reduced in the vicinity of the dead end section where it protrudes by the structures of the second cam 26 and the first pin holder section 15 and at the same time latched at the protruding dead end section, it is possible to prevent cracks from being generated in the loop pin. Furthermore, because the feeding pin is latched in the protruded condition, the inserting head section is securely affixed to the socket section.

Because the second pin holder section 18 is linked to the head end of the driving arm 13 via the link member 27, it rotates in the form of toggle at the section of hole 13*c* and stops the movement of the second pin holder section 18 at the dead end section. That is, when the link member 27 rotates around the hole 13*c*, the second pin holder section 18 scarcely advances. With this mechanism, jumping back of the second feeding pin 19 is able to be prevented, and the socket section 28*a* is able to be held and fixed to the head end of the guide member 20.

And another embodiment of this invention, a loop pin connecting device for connecting the inserting head section to the holder section of the loop pin having an inserting head section at one end section of a filament section and a holder section for receiving the inserting head section at its other end section, the loop pin connecting device comprising the first feeding pin 16 for holding the inserting head section of the loop pin arranged at the predetermined first position, on a tip end section of said first feeding pin 16 and for moving, said inserting head section to the scheduled connection position of the inserting head section and the holder section, and the second feeding pin 19 for holding the holder section of the loop pin arranged at the predetermined second position on a tip end section of said second feeding pin 19 and for moving said holder section to said scheduled connection position, and the first and the second positions being located on the loop pin connecting device with a specified distance provided for each other, and the individual stroke lengths of the first feeding pin 16 and the second feeding pin 19 being established by one driving arm 13 rotatably installed by a grip section 11 mounted to a main body portion of the loop pin connecting device proper.

The stroke length of the second feeding pin 19 is set longer than the stroke length of the first feeding pin 16.

The first engaging position in which the first feeding pin 16 directly or indirectly engages with the driving arm 13 differs from the second engaging position in which the second feeding pin 19 directly or indirectly engages with the driving arm 13, respectively.

The distance between the position of rotation center axis of the driving arm 13 and the second engaging position is set longer than the distance between the position of rotation center axis and the first engagement position.

The first position and the second position are separated each other by a specified distance in the horizontal direction, as well as separated each other by a specified distance in the vertical direction.

The second feeding pin 19 is configured in such a manner that it is guided inside the guide member protruded in the form of curvature from the second position to the first position.

The tip end section of the guide member in the form of curvature is arranged at the position intersecting the axis of the first feeding pin 16 and at the scheduled connection position of the inserting head section and the holder section of said loop pin.

Next, a method for using the loop pin connecting device (hereinafter referred to as a loop pin gun), utilizing a unit of loop pins, in which a plurality of loop pins are parallely arranged and fastened to each other with connecting bars, will be explained hereunder.

Figure 10:
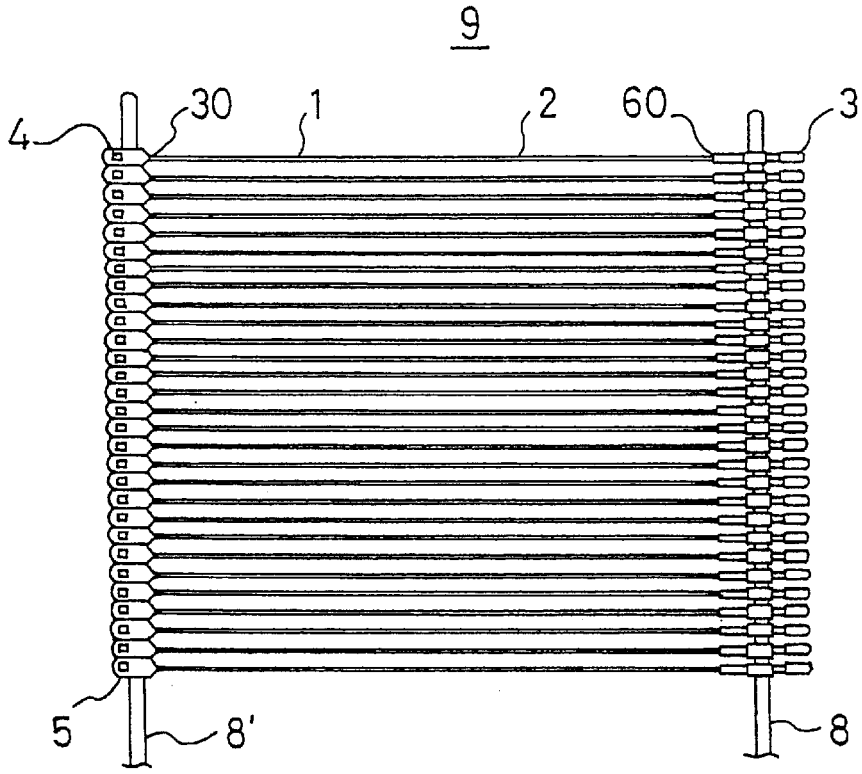
FIGS. 10(A) to (D) show an embodiment of a configuration of the loop pin and a group of loop pins.
Figure 10:
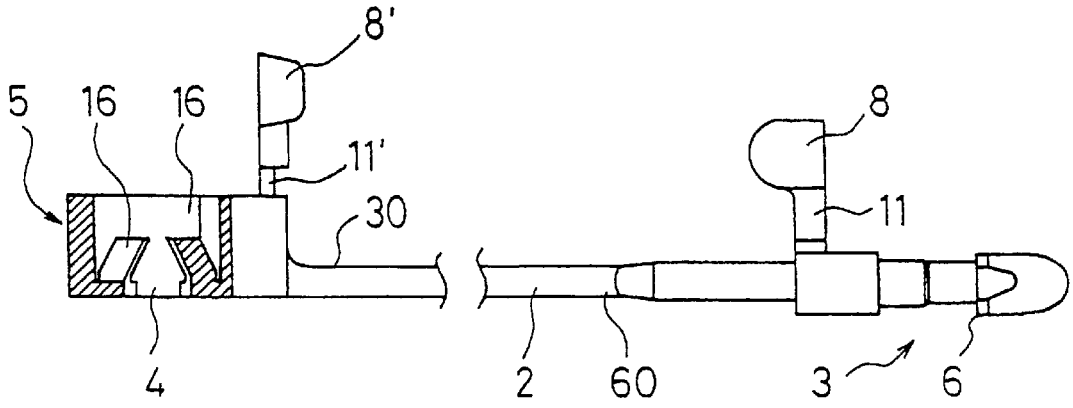
Figure 10C:
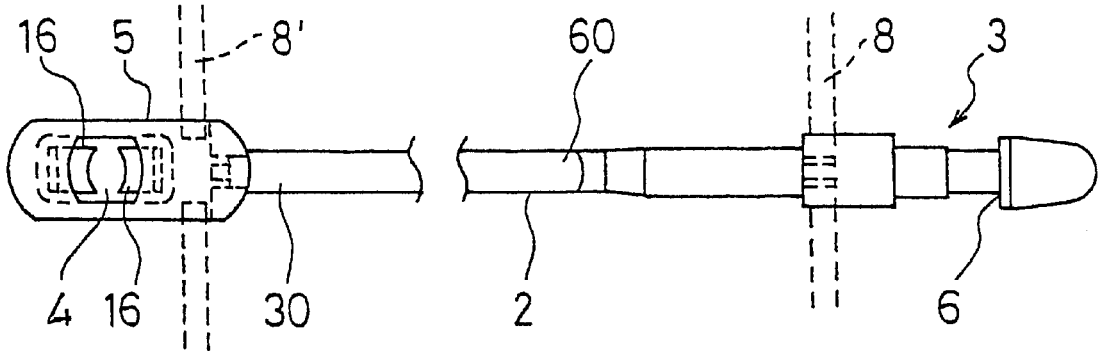

First of all, an explanation about an embodiment of a configuration of a respective loop pin and a unit of loop pins which ill be used in the loop pin gun of the present invention, will be given with reference to FIG. 10.

Note that, each of the loop pins has a configuration as shown in FIG. 10(A) to FIG. 10(D), such that the loop pins comprise an insertion head 3 provided on one end portion 60 of a filament 2 and having an appropriate mating part 6 and a socket portion 5 provided on the other end 30 of the filament 2 and having a hole 4 provided with blocking blades 16 therein for irreversibly passing the insertion head 3.

The loop pin 1 is so formed that the filament 2, the insertion head 3 and the socket portion 5 are integrally formed as one body.

Figure 10D:
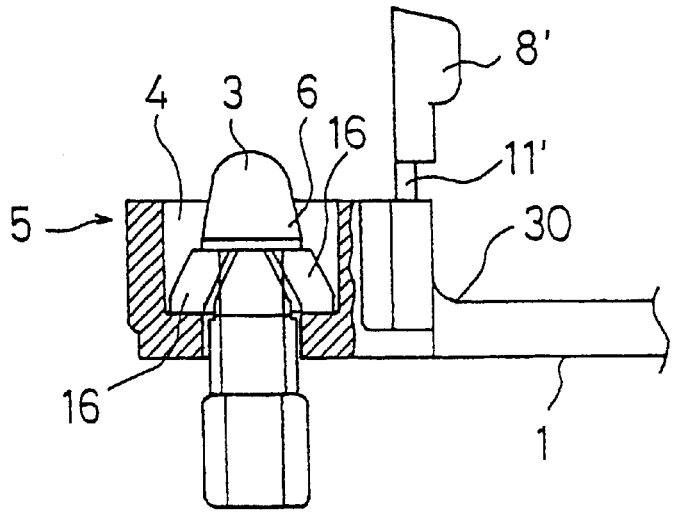

As shown in FIG. 10(D), when the insertion head 3 has been inserted into the socket portion 5 through its hole 4, the appropriate mating part 6, which may be a step-like portion, for example, can fixedly engaged with the blocking blades 16 so that the insertion head 3 cannot move in the opposite direction to its insertion direction, thus preventing the insertion head 3 from being removed from the socket portion 5 easily.

In the present invention, since the loop pin 1 is used to attach it to specific commercial goods to maintain a suitable tag or label on the filament 2, utilizing a mechanical operation, the above-mentioned loop pin gun 10 of the present invention is used.

In the present invention, when each one of the loop pins 1 is used to be attached to such commercial goods by being shot out respectively by the loop pin gun 10 of the present invention, a unit of loop pin 9 is desirably used.

Note that in the unit of loop pin 9 of the present invention, as shown in FIG. 10(A), a plurality of the loop pins 1 are arranged in parallel to each other and are temporarily attached to a pair of connecting bars 8 and 8' with a weak connection link 11 and 11' which is easily cut by a suitable portion provided on the loop pin gun 10 so as to easily separate each one of the loop pins 1 from the connecting bars 8 and 8'.

In the present invention, the connecting bar 8 is provided on or in the vicinity of the insertion head 3 while the connecting bar 8' is provided on or in the vicinity of the socket portion 5, respectively.

Figure 11:
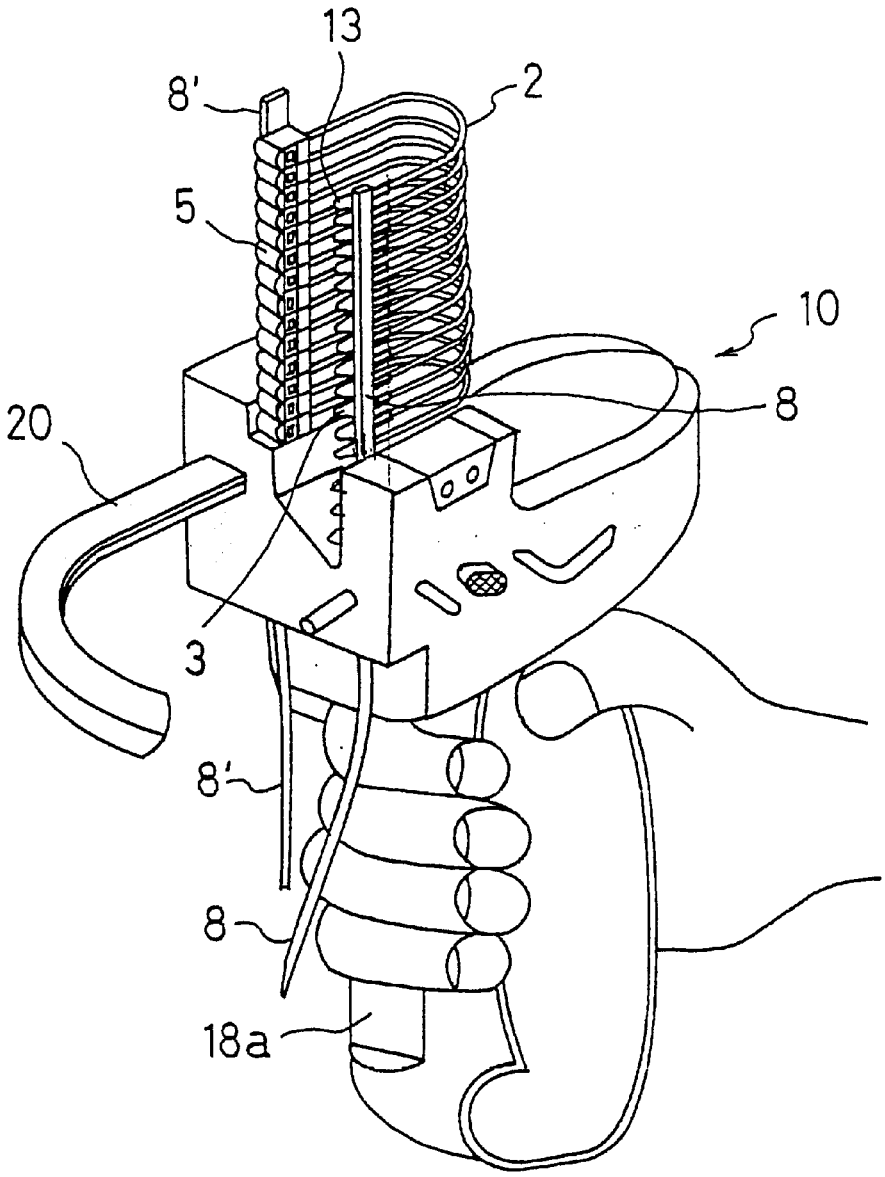
FIG. 11 explains the problems a loop gun of the present invention as shown in FIGS. 1 to 9, when it is used with a unit of loop pins.
Figure 13A:
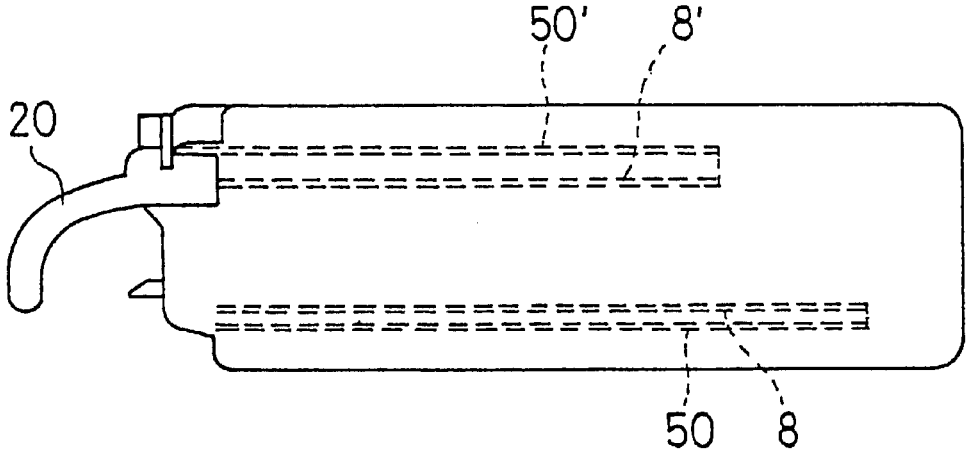
FIG. 13(A), FIG. 13(B), FIG. 14 and FIG. 15 show separate embodiments of a loop gun of the present invention which can remove the above-mentioned problem therefrom.
Figure 13B:
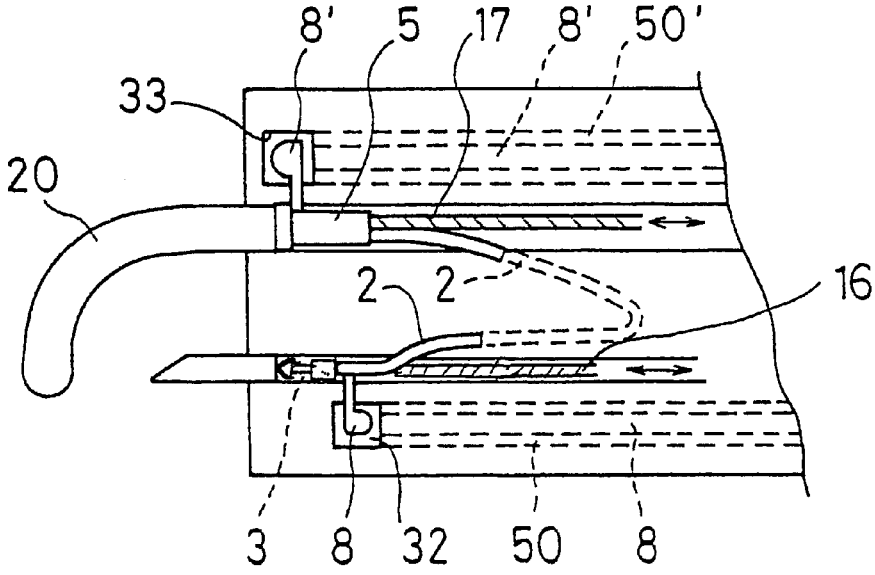

When a unit of loop pins 9 is mounted on the loop pin gun 10 and each one of the loop pins 1 is shot from the gun 10, as shown in FIG. 11, the unit of loop pins 9 is first bent so as to have a configuration similar to a U-shape by closing the connecting bars 8 and 8' to each other, and thereafter, each tip portion of the connecting bars 8 and 8' is inserted into insertion vertical grooves 32 and 32' (which are shown in FIG. 13(B)), respectively, so that the unit of loop pins 9 is set on the loop pin gun 10.

After that, every time an operating lever 18*a* is actuated, the above-mentioned mechanism is operated and a loop pin transferring mechanism is also actuated so that each of the loop pins 1 is shot one by one a loop is created.

On the other hand, as a result of the operation of this loop pin gun 10, the connecting bars 8 and 8' separated from the unit of loop pin 9 are simultaneously output downwardly from the loop pin gun 10.

In this situation, as shown in FIG. 11, such connecting bars 8 and 8' moving downwardly will impinge on or contact the skin of the fingers of an operator, thereby causing the operator to feel uncomfortable in operating the loop pin gun 10 as well as the operator being damaged on his or her hands.

Figure 12:
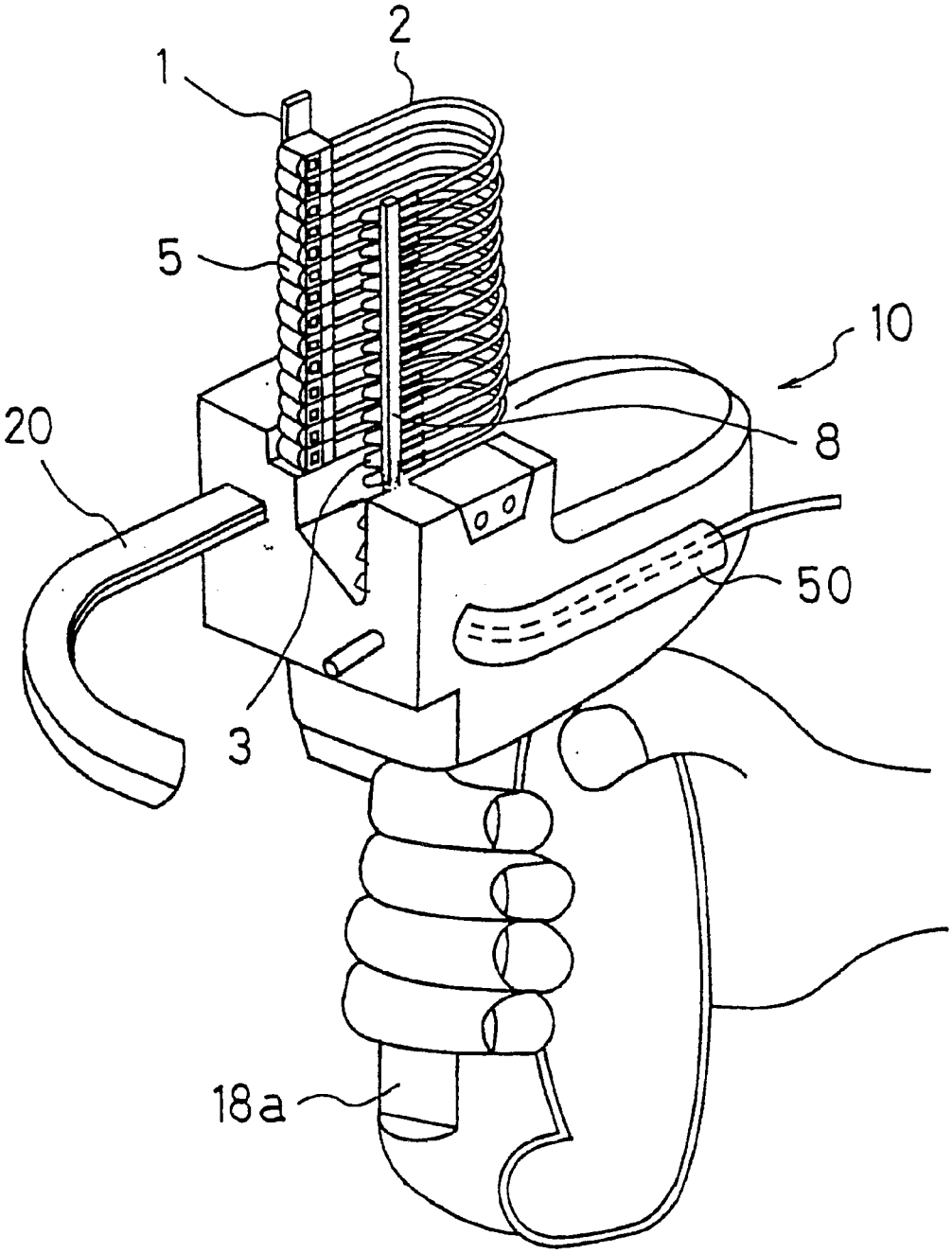
FIG. 12 shows an embodiment of a loop gun of the present invention which can remove the above-mentioned problem therefrom.

Accordingly, in this embodiment of the present invention of the loop pin gun 10, as shown in FIG. 12, a pari of guiding passages 50 and 50' are provided on an external side surface of the loop pin gun 10 whereby the connecting bars 8 and 8' separated from the unit of loop pins 9 are guided therethrough to a rear portion of the loop pin gun 10 so as to withdraw the same therefrom without touching a hand of an operator.

Note that FIG. 12 does only show a guiding passage 50 but another guiding passage 50' is of course provided on an opposite side surface of the loop pin gun 10 (not shown in FIG. 12).

In this embodiment, the guiding passages 50 and 50' are connected to the insertion vertical grooves 32 and 32', respectively.

Figure 14:
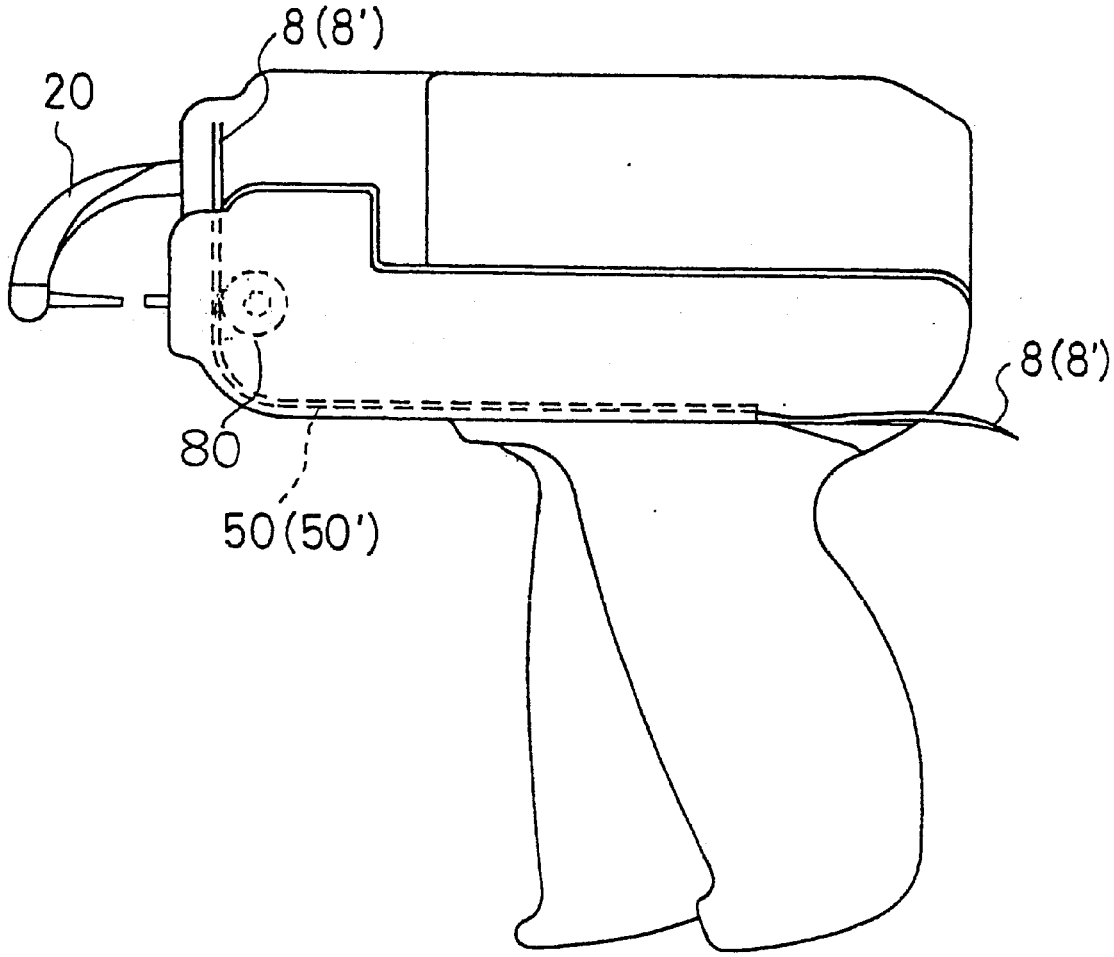

On the other hand, in a separate embodiment of the present invention as shown in FIGS. 13 and 14, the guiding passages 50 and 50' can be formed as a groove, a hollow pipe, a simple guide plate or guide ring or the like.

Further in this embodiment, in order to maintain a smooth movement of the connecting bars 8 and 8' through and within guiding passages 50 and 50', a suitable feeding means for positively feeding the connecting bars 8 and 8', therethrough in response to the operation of the operation lever 18*a*, may be provided along the line of guiding passages 50 and 50' or at a suitable position closer to the insertion vertical groove 32 and 32'.

For example, a roller or a gear roller which is positively rotate or a cam or a latch which is moved in a predetermined constant direction, can be used for this purpose.

Alternatively, the connecting bars 8 and 8' per se, can be made of a flexible belt-like member or a film-like member each of which preferably has a small thickness.

Figure 15:
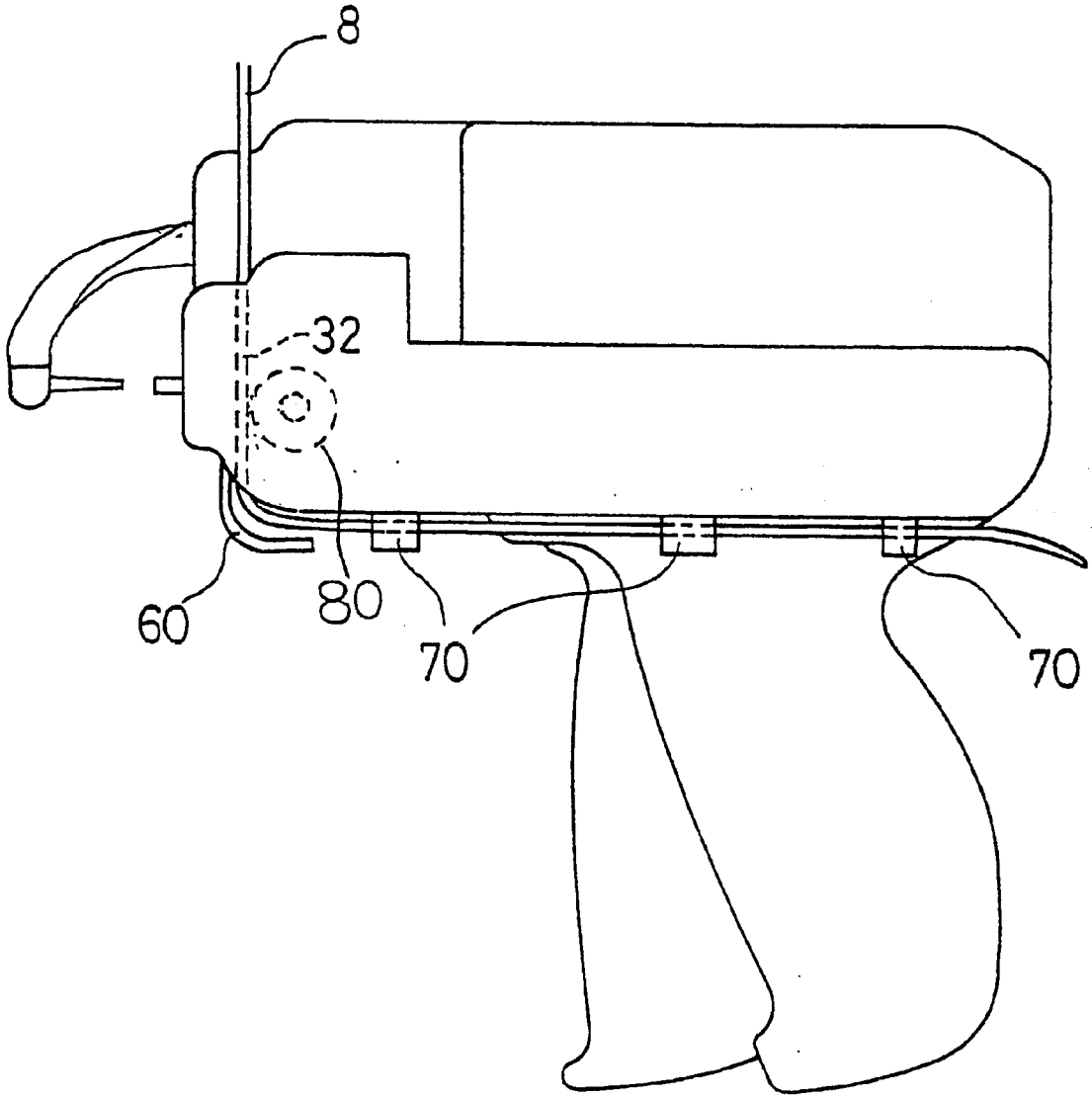

On the other hand, as shown in FIG. 15, the connecting bars 8 and 8' can be withdrawn from inside a main body of the loop pin gun 10 at a position bent by a suitable guide plate 60 so as to be guided to a rear portion of the loop pin 10 via several guide rings 70, for example, the guiding passages 50 and 50' of which are different from that as shown in FIG. 12 which is a tube-like member.

Another example of the present invention will be explained hereunder with reference to FIG. 16.

Figure 16:
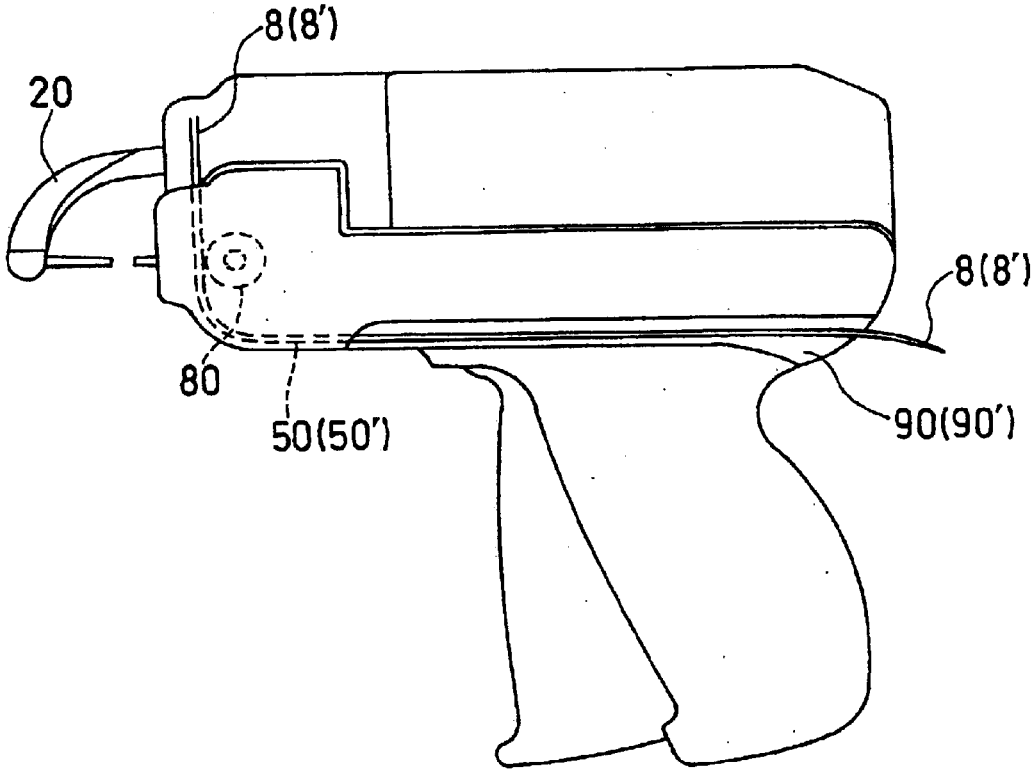
FIG. 16 is similar to FIG. 15 but shows another embodiment thereof.

As shown in FIG. 16, although this example is basically identical to those of the previous examples as mentioned above, a difference therefrom is that a part of the guiding passage 50 (50'), for example, around a first one third of the whole length of the guiding passage 50 (50') is formed inside the main body of the gun and the remaining part thereof, for example, around the last two thirds thereof is formed on an external side wall of the gun so that the guiding passage 90 (90') comprises an open-type groove formed along the external side wall of the gun.

Therefore, an operator can easily observe the connecting bars 8 and 8' while they are running through this open-type groove of the guiding passage 90 (90').

The present invention is not intended to be limited to the above-mentioned embodiment, but various design changes are possible based on the technological ideas of the present invention.

The present invention adopts the configuration as described above, and since the loop pin group is able to be mounted to the device with the height position of the socket section and the inserting head section varied, respectively, entangling of the filament section is able to be prevented, and occurrence of jams is able to be impeded while it is in operation. Consequently, the working efficiency is able to be improved. In addition, since the width of the device is able to be reduced, the workability is increased.

Furthermore, because the feeding speed of the first feeding pin is ale to be restricted in the vicinity of the dead end, it is possible to prevent generation of cracks in the loop pin. In addition, since the second feeding pin is able to held in the form of a toggle near the dead end, the loop pin socket section is able to be held to the head end section of the guide member, and jumping back operation is able to be impeded. Consequently, reliable engagement of the loop pin is able to be achieved.

What is claimed is:

1. A loop pin connecting device for connecting an inserting head section to a holder section of a loop pin, the loop pin having the inserting head section at one end section of a filament section and the holder section for receiving the inserting head section at another, opposite end section of the filament section, the loop pin connecting device comprising:

a first feeding pin for i) holding the inserting head section of the loop pin arranged at a predetermined first position on a tip end section of said first feeding pin and for ii) moving said inserting head section to a scheduled connection position of the inserting head section and the holder section, and a second feeding pin for i) holding the holder section of the loop pin arranged at a predetermined second position on a tip end section of said second feeding pin and for ii) moving said holder section to said scheduled connection position, the first and second positions being located on the loop pin connecting device, individual stroke lengths of the first feeding pin and the second feeding pin being established by one driving arm rotatably installed by a grip section mounted to a main body portion of the loop pin connection device.

2. The loop pin connecting device according to claim 1 wherein the stroke length of the second feeding pin is set longer than the stroke length of the first feeding pin.

3. The loop pin connecting device according to claim 1 wherein a first engaging position in which the first feeding pin engages with the driving arm differs from a second engaging position in which the second feeding pin engages with the driving arm, respectively.

4. The loop pin connecting device according to claim 3, wherein a distance between a position of rotation center axis of the driving arm and the second engaging position is set longer than the distance between the position of rotation center axis and the first engagement position.

5. The loop pin connecting device according to claim 1 wherein the first position and second position are separated each other by a specified distance in a horizontal direction, as well as separated each other by a specific distance in a vertical direction.

6. The loop pin connecting device according to claim 1 wherein the second feeding pin is configured in such a manner that the second pin is guided inside a guide member protruded in curvature from the second position to the first position.

7. The loop pin connecting device according to claim 1, further comprising:

a curved guide member having a tip end section, the tip end section of the guide member arranged at a position intersecting an axis of the first feeding pin with said scheduled connection position.

8. A loop pin connecting device for use with a loop pin having a filament section terminated at a first end by an inserting head section and terminated at a second end by a holder section for receiving the inserting head section, the loop pin connecting device comprising:

a first feeding pin with a first tip end section, the first feeding pin i) holding the inserting head section at a predetermined first position on the first tip end section and ii) moving the inserting head section to a connection position of the inserting head section and the holder section; and a second feeding pin with a second tip end section, the second feeding pin i) holding the holder section at a predetermined second position on the second tip end section and ii) moving the holder section to the connection position, the first and second positions being located on the loop pin connecting device, individual stroke lengths of the first feeding pin and the second feeding pin being established by a driving arm rotatably installed by a grip section mounted to a main body portion of the loop pin connection device.

9. The loop pin connecting device according to claim 8, wherein, the stroke length of the second feeding pin is longer than the stroke length of the first feeding pin.

10. The loop pin connecting device according to claim 8, wherein, a first engaging position in which the first feeding pin engages with the driving arm differs from a second engaging position in which the second feeding pin engages with the driving arm.

11. The loop pin connecting device according to claim 10, wherein, a distance between a position of rotation center axis of the driving arm and the second engaging position is longer than a distance between the position of rotation center axis and the first engagement position.

12. The loop pin connecting device according to claim 8, wherein, the first position and second position are separated each other by a horizontal distance and by a vertical distance.

13. The loop pin connecting device according to claim 8, further comprising a curved guide member and wherein the second feeding pin is guided inside the guide member.

14. The loop pin connecting device according to claim 8, further comprising:

a curved guide member having a tip end section, the tip end section of the guide member located at a position where an axis of the first feeding pin intersects the scheduled connection position.

* * * * *